US010234151B2

(12) United States Patent
Yumoto et al.

(10) Patent No.: US 10,234,151 B2
(45) Date of Patent: Mar. 19, 2019

(54) AIR CONDITIONING APPARATUS

(71) Applicant: DAIKIN INDUSTRIES, LTD., Osaka-shi, Osaka (JP)

(72) Inventors: Yoshiaki Yumoto, Sakai (JP); Yukako Kanazawa, Sakai (JP); Keitarou Hoshika, Sakai (JP); Junichi Shimoda, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 256 days.

(21) Appl. No.: 14/762,366

(22) PCT Filed: Dec. 16, 2013

(86) PCT No.: PCT/JP2013/083575

§ 371 (c)(1),
(2) Date: Jul. 21, 2015

(87) PCT Pub. No.: WO2014/119149

PCT Pub. Date: Aug. 7, 2014

(65) Prior Publication Data

US 2015/0362199 A1 Dec. 17, 2015

(30) Foreign Application Priority Data

Jan. 29, 2013 (JP) ..... 2013-014803
Oct. 31, 2013 (JP) ..... 2013-226155

(51) Int. Cl.
*F24F 5/00* (2006.01)
*F25B 9/00* (2006.01)
*F25B 13/00* (2006.01)

(52) U.S. Cl.
CPC ..... *F24F 5/001* (2013.01); *F25B 9/002* (2013.01); *F25B 13/00* (2013.01);
(Continued)

(58) Field of Classification Search
CPC ..... F24F 5/001; F25B 9/002; F25B 13/00; F25B 2400/16; F25B 2400/13
See application file for complete search history.

(56) References Cited

U.S. PATENT DOCUMENTS 6,581,397 B1 6/2003 Taira et al.

FOREIGN PATENT DOCUMENTS

EP 0 685 692 A2 12/1995
EP 1 628 088 A2 2/2006
(Continued)

OTHER PUBLICATIONS

Fukui et al., Refrigeration Cycle Device, Oct. 11, 2012, JP2012193897A, Whole Document.*

(Continued)

*Primary Examiner* — Larry Furdge
(74) *Attorney, Agent, or Firm* — Global IP Counselors, LLP

(57) ABSTRACT

An air conditioning apparatus includes a refrigerant circuit having a compressor, a radiator, an upstream side expansion valve, a receiver, a downstream side expansion valve, an evaporator, and a receiver gas vent pipe. Gas vent control is performed so that gas refrigerant is led from a receiver to the suction side of a compressor via a receiver gas vent pipe by opening a receiver gas vent valve. Upstream side expansion valve subcooling control is performed so that the opening of an upstream side expansion valve is changed such that the subcooling of refrigerant is set to target subcooling at the outlet of a radiator. Downstream side expansion valve suction wetting control is performed so that the opening of a downstream side expansion valve is changed such that refrigerant is in a wetting state and the dryness is set to target dryness at the outlet of an evaporator.

2 Claims, 6 Drawing Sheets

(52) U.S. Cl.
CPC ..... *F25B 2313/0314* (2013.01); *F25B 2313/0315* (2013.01); *F25B 2400/13* (2013.01); *F25B 2400/16* (2013.01); *F25B 2600/2513* (2013.01); *F25B 2700/2116* (2013.01); *F25B 2700/2117* (2013.01); *F25B 2700/21151* (2013.01); *F25B 2700/21152* (2013.01)

(56) References Cited

FOREIGN PATENT DOCUMENTS

| | | | | |
|---|---|---|---|---|
| JP | H02267481 | A | * | 11/1990 |
| JP | 9-210491 | A | | 8/1997 |
| JP | 10-132393 | A | | 5/1998 |
| JP | H11248267 | A | * | 9/1999 |
| JP | 2001-65953 | A | | 3/2001 |
| JP | 2001-194015 | A | | 7/2001 |
| JP | 2001194015 | A | * | 7/2001 |
| JP | 2001-227822 | A | | 8/2001 |
| JP | 2001-241780 | A | | 9/2001 |
| JP | 2001-295762 | A | | 10/2001 |
| JP | 2002-89988 | A | | 3/2002 |
| JP | 2012-193897 | A | | 10/2012 |
| JP | 2012193897 | A | * | 10/2012 |

OTHER PUBLICATIONS

Matsuoka, Air Conditioner, Nov. 1, 1990, JPH02267481A, Whole Document.*

Taira et al., Freezing Apparatus, Jul. 17, 2001, JP2001194015A, Whole Document.*

Nanatane et al., Refrigeration Cycle, Sep. 14, 1999, JPH11248267A, Whole Document.*

International Preliminary Report of corresponding PCT Application No. PCT/JP2013/083575 dated Aug. 13, 2015.

International Search Report of corresponding PCT Application No. PCT/JP2013/083575 dated Mar. 18, 2014.

European Search Report of corresponding EP Application No. 13 87 3872.9 dated Apr. 5, 2017.

* cited by examiner

| CONDITIONS FOR CHANGING ΔMVm | VALUES FOR ΔMVm |
|---|---|
| Td > TdH<br>OR<br>TdSH > TdSHH | ΔMVmH |
| Td > TdM<br>OR<br>TdSH > TdSHM | ΔMVmM |
| Td < TdL<br>OR<br>TdSH < TdSHL | ΔMVmL |

HERE, TdH >TdM > TdL > Tdo
TdSHH > TdSHM > TdSHL > TdSHo
ΔMVmH > ΔMVmM > ΔMVmL

FIG. 6

AIR CONDITIONING APPARATUS

CROSS-REFERENCE TO RELATED APPLICATIONS

This U.S. National stage application claims priority under 35 U.S.C. § 119(a) to Japanese Patent Application Nos. 2013-014803, filed in Japan on Jan. 29, 2013, and 2013-226155, filed in Japan on Oct. 31, 2013, the entire contents of which are hereby incorporated herein by reference.

TECHNICAL FIELD

The present invention relates to an air conditioning apparatus and in particular relates to an air conditioning apparatus which has a refrigerant circuit which is configured by connecting a compressor, a radiator, an upstream side expansion valve, a receiver, a downstream side expansion valve, and an evaporator and where it is possible for refrigerant to circulate in the order of the compressor, the radiator, the upstream side expansion valve, the receiver, the downstream side expansion valve, and the evaporator.

BACKGROUND ART

In the background art, there is an air conditioning apparatus which has a refrigerant circuit where expansion valves are provided on the upstream side and the downstream side of a receiver and gas refrigerant is injected from the receiver into a compressor as shown in Japanese Unexamined Patent Application Publication No. H10-132393. In detail, the air conditioning apparatus has the refrigerant circuit which is configured by connecting the compressor, a radiator, an upstream side expansion valve, the receiver, a downstream side expansion valve, and an evaporator. An injection circuit which injects intermediate-pressure gas refrigerant from the receiver into the compressor is provided in the refrigerant circuit. Then, in the air conditioning apparatus, operation where refrigerant is circulated in the order of the compressor, the radiator, the upstream side expansion valve, the receiver, the downstream side expansion valve, and the evaporator is performed and intermediate-pressure gas refrigerant is injected from the receiver into the compressor.

In addition, there is an air conditioning apparatus which uses R32 as refrigerant as shown in Japanese Unexamined Patent Application Publication No, 2001-194015. In detail, the air conditioning apparatus has a refrigerant circuit which is configured by connecting a compressor, a radiator, an expansion valve, and an evaporator. Then, in the air conditioning apparatus, there is suction wetting control where the number of rotations of the compressor and/or the opening of the expansion valve is changed such that refrigerant at the outlet of the evaporator is in a designated wetting state while performing operation where refrigerant is circulated in the order of the compressor, the radiator, the expansion valve, and the evaporator.

SUMMARY

According to the air conditioning apparatuses in the background art described above, it is thought that, for example, R32 is used as the refrigerant as in Japanese Unexamined Patent Application Publication No. 2001-19401 in the air conditioning apparatus which has the refrigerant circuit where the expansion valves are provided on the upstream side and the downstream side of the receiver and gas refrigerant is injected from the receiver into the compressor as in Japanese Unexamined Patent Application Publication No. H10-132393. Here, in a case where R32 is used as the refrigerant, it is necessary to perfhrm suction wetting control considering that it is easy for the temperature of the refrigerant which is discharged from the compressor to increase as in Japanese Unexamined Patent Application Publication No. 2001-19401.

However, although the refrigerant circuit which has one expansion valve without having a receiver is described, a refrigerant circuit, where the expansion valves are provided on the upstream side and the downstream side of the receiver and gas refrigerant is injected from the receiver into the compressor, is not described in Japanese Unexamined Patent Application Publication No. 2001-19401. For this reason, there is a problem in how control which includes the suction wetting control is to be performed in the refrigerant circuit where the expansion valves are provided on the upstream side and the downstream side of the receiver and gas refrigerant is injected from the receiver into the compressor as in Japanese Unexamined Patent Application Publication No. H10-132393. In addition, there is a concern that an increase in the temperature of the refrigerant which is discharged from the compressor will be generated as described above when the compressor suctions in refrigerant where the dryness is higher than the designated wetting state and that liquid compression will be generated when the compressor suctions in refrigerant where the dryness is lower than the designated wetting state. For this reason, high controllability is demanded with regard to the suction wetting control from the point of view of securing the reliability of the compressor. In addition, an accumulator is provided on the suction side of the compressor in PTL 1 Japanese Unexamined Patent Application Publication Nos. H10-132393 and 2001-19401, but since it is difficult for refrigerant to be suctioned into the compressor in a wetting state using the gas and liquid separation function of the accumulator in a case where the accumulator is provided in this manner, it is said that providing the accumulator on the suction side of the compressor is not preferable in a case where the suction wetting control is performed. However, since not providing the accumulator on the suction side of the compressor has the meaning of heightening concerns that liquid compression will be generated, it is necessary for controllability of the suction wetting control to be further improved so that the compressor does not suction in refrigerant where the dryness is lower than the designated wetting state.

In this manner, high controllability is demanded in suction wetting control from the point of view of securing the reliability of the compressor with it being necessary to perform suction wetting control in a case where R32 is used as the refrigerant in the air conditioning apparatus which has the refrigerant circuit where the expansion valves are provided on the upstream side and the downstream side of the receiver and gas refrigerant is injected from the receiver into the compressor.

The problem of the present invention is for it to be possible to perform suction wetting control with high controllability with R32 used as refrigerant in an air conditioning apparatus which has a refrigerant circuit where expansion valves are provided on the upstream side and the downstream side of a receiver and gas refrigerant is injected from the receiver into a compressor.

An air conditioning apparatus according to a first aspect is an air conditioning apparatus which has a refrigerant circuit which is configured by connecting a compressor, a radiator, an upstream side expansion valve, a receiver, a downstream side expansion valve, and an evaporator and where it is possible for the refrigerant to circulate in the order of the compressor, the radiator, the upstream side expansion valve, the receiver, the downstream side expansion valve, and the evaporator. R32 is enclosed in the refrigerant circuit as the refrigerant. In addition, the refrigerant circuit is provided with a receiver gas vent pipe which is for leading gas refrigerant which accumulates inside the receiver to the suction side of the compressor and which has a receiver gas vent valve which is able to be controlled to be opened and closed. Then, here, a gas vent control is performed so that the gas refrigerant is led from the receiver to the suction side of the compressor via the receiver gas vent pipe by opening the receiver gas vent valve, an upstream side expansion valve subcooling control is performed so that an opening of the upstream side expansion valve is changed such that a subcooling of the refrigerant is set to a target subcooling at the outlet of the radiator, and a downstream side expansion valve suction wetting control is performed so that the opening of the downstream side expansion valve is changed such that the refrigerant is in a wetting state and a dryness is set to a target dryness at the outlet of the evaporator.

Here, due to there being the refrigerant circuit where the expansion valves are provided on the upstream side and the downstream side of the receiver and the gas refrigerant is injected from the receiver into the compressor, it is preferable that the device is controlled so that it is possible for the flow rate of the refrigerant which flows into the evaporator to be directly controlled in the suction wetting control.

Therefore, here, the refrigerant is in a wetting state and the dryness is set to the target dryness at the outlet of the evaporator by performing the downstream side expansion valve suction wetting control where the opening of the downstream side expansion valve, which is provided on the downstream side of the receiver, is changed as described above.

However, at this time, it is preferable for the refrigerant which is sent from the receiver to the downstream side expansion valve to be normally maintained at the state of the liquid refrigerant in order for the controllability of the downstream side expansion valve to be suitable. Then, it is necessary for the flow rates of the as refrigerant and the liquid refrigerant which flow into the receiver to be stabilized, for the gas refrigerant not to flow from the receiver into the downstream side expansion valve, and for the liquid refrigerant to not return from the receiver gas vent pipe to the suction side of the compressor in order for the refrigerant which is sent from the receiver to the downstream side expansion valve to be normally maintained in the state of the liquid refrigerant.

Therefore, here, when performing the downstream side expansion valve suction wetting control, the gas refrigerant is led from the receiver to the suction side of the compressor via the receiver gas vent pipe which is provided in the receiver by performing the gas vent control where the receiver gas vent valve is opened, and the subcooling of the refrigerant at the outlet of the radiator is set to the target subcooling by performing the upstream side expansion valve subcooling control where the opening of the upstream side expansion valve which is provided on the upstream side of the receiver is changed as described above. By doing this, the flow rates of the gas refrigerant and the liquid refrigerant which passes through the upstream side expansion valve and flow into the receiver are stabilized and the gas refrigerant is stably vented out from the receiver via the receiver gas vent pipe due to the subcooling of the refrigerant at the outlet of the radiator being set to the target subcooling. For this reason, the state where there normally is the liquid refrigerant in the receiver is maintained and the refrigerant which is sent from the receiver to the downstream side expansion valve is normally maintained in the state of the liquid refrigerant.

Due to this, here, it is possible to perform the suction wetting control with high controllability when R32 is used as the refrigerant.

An air conditioning apparatus according to a second aspect is the air conditioning apparatus according to the first aspect where the downstream side expansion valve suction wetting control is a control where the opening of the downstream side expansion valve is changed such that a temperature of the refrigerant which is discharged from the compressor is set to a target discharge temperature which is equivalent to a case where the dryness of refrigerant at the outlet of the evaporator is set to the target dryness.

Here, it is possible to accurately perform the suction wetting control since the downstream side expansion valve suction wetting control is performed based on the temperature of the refrigerant which is discharged from the compressor.

An air conditioning apparatus according to a third aspect is the air conditioning apparatus according to the second aspect where the upstream side expansion valve subcooling control is performed with regard to the upstream side expansion valve and the downstream side expansion valve suction wetting control is performed while a discharge temperature protection control is performed with regard to the downstream side expansion valve such that a designated correction opening is added to a lower limit opening which is a control lower limit of the downstream side expansion valve in a case of satisfying a discharge temperature protection condition, which is determined when the temperature of the refrigerant which is discharged from the compressor increases to a protection discharge temperature which is higher than the target discharge temperature or when a state amount which is correlated with the temperature of the refrigerant which is discharged from the compressor reaches a protection state amount which corresponds to the protection discharge temperature.

Even performing the downstream side expansion valve suction wetting control, it is not possible to negate concerns that the temperature of the refrigerant which is discharged from the compressor will excessively increase due to any unregular circumstances.

Therefore, here, the upstream side expansion valve subcooling control is performed with regard to the upstream side expansion valve and the downstream side expansion valve suction wetting control is performed along with performing of discharge temperature protection control, where the designated correction opening is added to the lower limit opening which is the control lower limit of the downstream side expansion valve with regard to the downstream side expansion valve in a case of satisfying a discharge temperature protection condition, which is determined when the temperature of the refrigerant which is discharged from the compressor increases to a protection discharge temperature which is higher than the target discharge temperature or when the state amount which is correlated with the temperature of the refrigerant which is discharged from the compressor reaches a protection state amount which corresponds to the protection discharge temperature as described above. For this reason, it is possible for the opening of the downstream side expansion valve to be increased in practice due to performing of discharge temperature protection control, where the correction opening is added to the lower limit opening of the downstream side expansion valve while continuing with the upstream side expansion valve subcooling control and the downstream side expansion valve suction wetting control.

Due to this, here, it is possible to effectively achieve discharge temperature protection by increasing the controllability in a direction where the opening is increased with regard to the downstream side expansion valve while maintaining a state of control which is the upstream side expansion valve subcooling control and the downstream side expansion valve suction wetting control in order to accurately perform the suction wetting control.

An air conditioning apparatus according to a fourth aspect is the air conditioning apparatus according to the third aspect where the correction opening is changed according to the temperature of the refrigerant which is discharged from the compressor or superheating of the refrigerant which is discharged from the compressor in the discharge temperature protection control.

Here, the correction opening is changed according to the temperature of the refrigerant which is discharged from the compressor or a superheating of the refrigerant which is discharged from the compressor in the discharge temperature protection control as described above. For example, the correction opening is increased in order to quickly increase the opening of the downstream side expansion valve in a case where the temperature of the refrigerant which is discharged from the compressor or superheating of the refrigerant which is discharged from the compressor is extremely high, and the correction opening is reduced in order to gradually increase the opening of the downstream side expansion valve in a case where the temperature of the refrigerant which is discharged from the compressor or superheating of the refrigerant which is discharged from the compressor is slightly high.

Due to this, here, it is possible to further improve controllability of discharge temperature protection by appropriately changing the extent to which the opening of the downstream side expansion valve is opened according to the circumstances in discharge temperature protection control.

BRIEF DESCRIPTION OF THE DRAWINGS

FIG. 6 is a table illustrating conditions for changing the correction opening and correction opening valves.

DESCRIPTION OF EMBODIMENTS

An embodiment and modified examples of an air conditioning apparatus according to the present embodiment will be described below based on the diagrams. Here, the detailed configuration of the air conditioning apparatus according to the present invention is not limited to the embodiment and modified examples described below and modifications are possible over a range which does not depart from the gist of the invention.

(1) Configuration of Air Conditioning Apparatus

Figure 1:
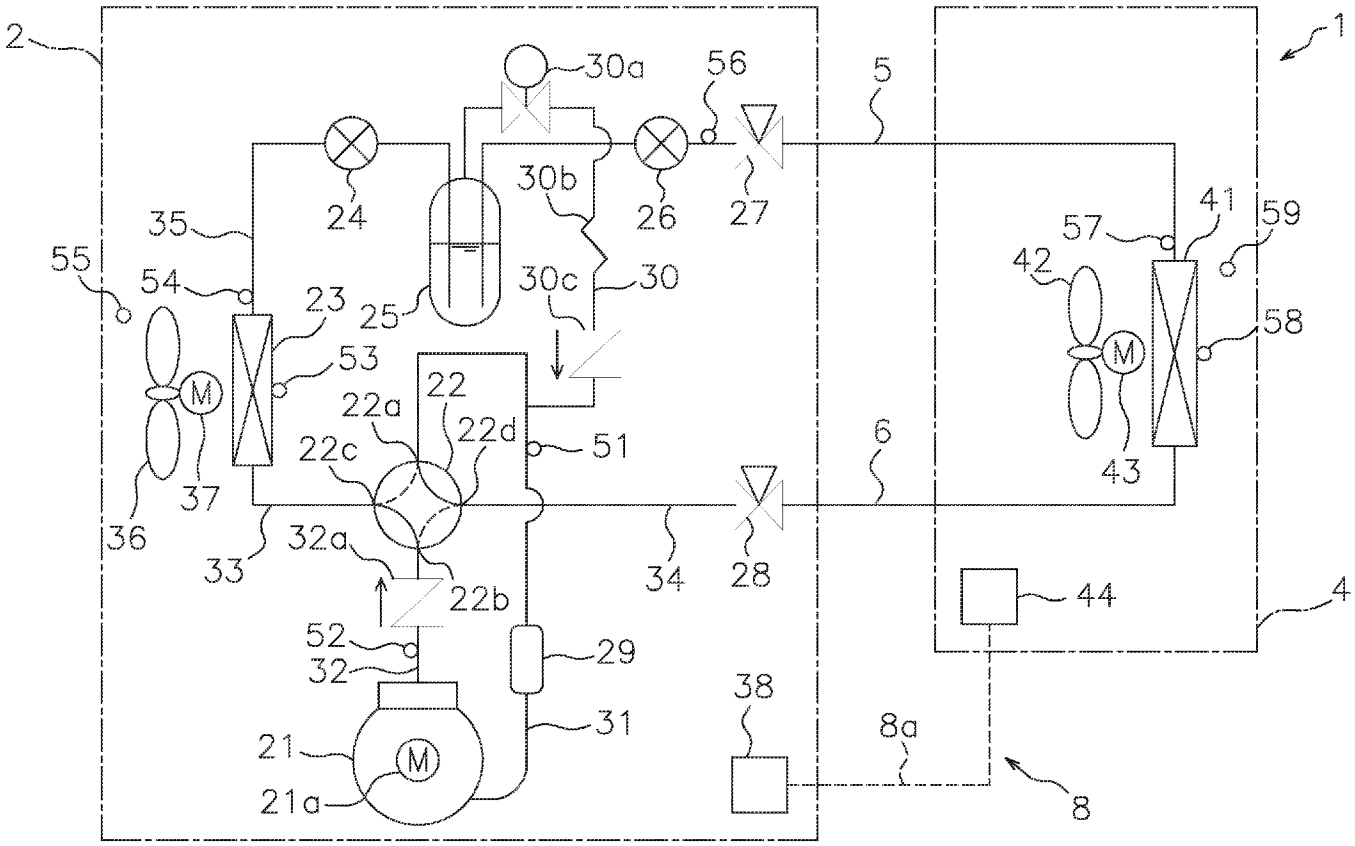
FIG. 1 is a schematic configuration diagram of an air conditioning apparatus according to an embodiment of the present embodiment.

FIG. 1 is a schematic configuration diagram of an air conditioning apparatus 1 according to an embodiment of the present embodiment.

The air conditioning apparatus 1 is an apparatus where it is possible to perform cooling and heating indoors such as in a building by performing a vapor compression type of refrigerating cycle. The air conditioning apparatus 1 is mainly configured by connecting an outdoor unit 2 and an indoor unit 4. Here, the outdoor unit 2 and the indoor unit 4 are connected via a liquid refrigerant linking pipe 5 and a gas refrigerant linking pipe 6. That is, a refrigerant circuit 10 which is a vapor compression type of refrigerant circuit in the air conditioning apparatus 1 is configured by connecting the outdoor unit 2 and the indoor unit 4 via the refrigerant linking pipes 5 and 6. R32 which is a type of HFC refrigerant is enclosed in the refrigerant circuit 10 as the refrigerant.

<Indoor Unit>

The indoor unit 4 is installed indoors and configures a portion of the refrigerant circuit 10. The indoor unit 4 mainly has an indoor heat exchanger 41.

The indoor heat exchanger 41 is a heat exchanger which cools indoor air by functioning as an evaporator for refrigerant during cooling operation and heats indoor air by functioning as a radiator during heating operation. The liquid side of the indoor heat exchanger 41 is connected to the liquid refrigerant linking pipe 5 and the gas side of the indoor heat exchanger 41 is connected to the gas refrigerant linking pipe 6.

The indoor unit 4 has an indoor fan 42 for supplying indoor air to indoors as supply air after heat exchange with refrigerant in the indoor heat exchanger 41 by suctioning in indoor air into the indoor unit 4. That is, the indoor unit 4 has the indoor fan 42 as a fan which supplies indoor air to the indoor heat exchanger 41 as a source for heating refrigerant or a source for cooling refrigerant which flows in the indoor heat exchanger 41. Here, a centrifugal fan, a multi-blade fan, or the like which is driven using an indoor fan motor 43 is used as the indoor fan 42. In addition, it is possible for the number of rotations of the indoor fan motor 43 to be changed using an inverter or the like.

Various types of sensors are provided in the indoor unit 4. In detail, an indoor heat exchange liquid side temperature sensor 57 which detects a temperature Trrl of refrigerant at the liquid side of the indoor heat exchanger 41 and an indoor heat exchange intermediate temperature sensor 58 which detects a temperature Trrm of refrigerant at an intermediate portion of the indoor heat exchanger 41 are provided in the indoor heat exchanger 41. An indoor temperature sensor 59 which detects a temperature Tra of indoor air which is suctioned into the indoor unit 4 is provided in the indoor unit 4.

The indoor unit 4 has an indoor side control section 44 which controls the actions of each section which configures the indoor unit 4. Then, the indoor side control section 44 has a microcomputer, memory, and the like provided to perform control of the indoor unit 4, and is able to perform transferring of control signals and the like to and from a remote controller (which is not shown in the diagrams) to operate the indoor units 4 individually and to perform transferring of control signals and the like to and from the outdoor unit 2 via a transfer line 8*a*.

<Outdoor Unit>

The outdoor unit 2 is installed outdoors and configures a portion of the refrigerant circuit 10. The outdoor units 2 mainly has a compressor 21, a four way switching valve 22, an outdoor heat exchanger 23, an outdoor heat exchange side expansion valve 24, a receiver 25, an indoor heat exchange side expansion valve 26, a liquid side shut-off valve 27, a gas side shut-off valve 28, and a receiver gas vent pipe 30.

The compressor 21 is a device which compresses low-pressure refrigerant so as to become high-pressure refrigerant in the refrigerating cycle. The compressor 21 has a sealed configuration where a positive displacement compression element (which is not shown in the diagrams) such as a rotary type or a scrolling type is rotationally driven using a compressor motor 21*a* which is controlled using an inverter. The suction side of the compressor 21 is connected to a suction pipe 31 and the discharge side of the compressor 21 is connected to a discharge pipe 32. The suction pipe 31 is a refrigerant pipe which connects the suction side of the compressor 21 and a first port 22*a* of the four way switching valve 22. An accumulator 29 with a low capacity which is associated with the compressor 21 is provided in the suction pipe 31. The discharge pipe 32 is a refrigerant pipe which connects the discharge side of the compressor 21 and a second port 22*b* of the four way switching valve 22. A check valve 32*a*, which only permits flow of refrigerant from the suction side of the compressor 21 to the second port 22*b* side of the four way switching valve 22, is provided in the discharge pipe 32.

The four way switching valve 22 is a switching valve for switching the direction of the flow of refrigerant in the refrigerant circuit 10. The four way switching valve 22 performs switching during cooling operation to a cooling cycle state where the outdoor heat exchanger 23 functions as a radiator for refrigerant which is compressed in the compressor 21 and the indoor heat exchanger 41 functions as an evaporator for refrigerant where heat is released in the outdoor heat exchanger 23. That is, the four way switching valve 22 performs switching during cooling operation so that the second port 22*b* and a third port 22*c* are linked and the first port 22*a* and a fourth port 22*d* are linked. Due to this, the discharge side of the compressor 21 (here, the discharge pipe 32) and the gas side of the outdoor heat exchanger 23 (here, a first gas refrigerant pipe 33) are connected (refer to the solid line in the four way switching valve 22 in FIG. 1). Moreover, the suction side of the compressor 21 (here, the suction pipe 31) and the gas refrigerant linking pipe 6 side (here, a second gas refrigerant pipe 34) are connected (refer to the solid line in the four way switching valve 22 in FIG. 1). In addition, the four way switching valve 22 performs switching during heating operation to a heating cycle state where the outdoor heat exchanger 23 functions as an evaporator for refrigerant where heat is released in the indoor heat exchanger 41 and the indoor heat exchanger 41 functions as a radiator for refrigerant which is compressed in the compressor 21. That is, the four way switching valve 22 performs switching during heating operation so that the second port 22*b* and the fourth port 22*d* are linked and the first port 22*a* and the third port 22*c* are linked. Due to this, the discharge side of the compressor 21 (here, the discharge pipe 32) and the gas refrigerant linking pipe 6 side (here, the second gas refrigerant pipe 34) are connected (refer to the dashed line in the four way switching valve 22 in FIG. 1). Moreover, the suction side of the compressor 21 (here, the suction pipe 31) and the gas side of the outdoor heat exchanger 23 (here, the first gas refrigerant pipe 33) are connected (refer to the dashed line in the four way switching valve 22 in FIG. 1). The first gas refrigerant pipe 33 is a refrigerant pipe which connects the third port 22*c* of the four way switching valve 22 and the gas side of the outdoor heat exchanger 23. The second gas refrigerant pipe 34 is a refrigerant pipe which connects the fourth port 22*d* of the four way switching valve 22 and the gas refrigerant linking pipe 6 side.

The outdoor heat exchanger 23 is a heat exchanger which functions as a radiator for refrigerant where outdoor air is a source for cooling during cooling operation and which functions as an evaporator for refrigerant where outdoor air is a source for heating during heating operation. The liquid side of the outdoor heat exchanger 23 is connected to a liquid refrigerant pipe 35 and the gas side of the outdoor heat exchanger 23 is connected to the first gas refrigerant pipe 33. The liquid refrigerant pipe 35 is a refrigerant pipe which connects the liquid side of the outdoor heat exchange 23 and the liquid refrigerant linking pipe 5 side. The outdoor heat exchanger 23 is a heat exchanger where flat perforated tubes is used as heat transfer tubes.

The outdoor heat exchange side expansion valve 24 is a valve which, during cooling operation, functions as an upstream side expansion valve which reduces the pressure of high-pressure refrigerant in the refrigerating cycle where heat is released in the outdoor heat exchanger 23 to an intermediate pressure in the refrigerating cycle. In addition, the outdoor heat exchange side expansion valve 24 is a valve which, during heating operation, functions as a downstream side expansion valve which reduces the pressure of intermediate-pressure refrigerant in the refrigerating cycle which is accumulated in the receiver 25 to a low pressure in the refrigerating cycle. The outdoor heat exchange side expansion valve 24 is provided at a portion, which is closer to the outdoor heat exchanger 23, in the liquid refrigerant pipe 35. Here, an electric expansion valve is used as the outdoor heat exchange side expansion valve 24.

The receiver 25 is provided between the outdoor heat exchange side expansion valve 24 and the indoor heat exchange side expansion valve 26. The receiver 25 is a vessel where it is possible for intermediate-pressure refrigerant in the refrigerating cycle to accumulate during cooling operation and during heating operation.

The indoor heat exchange side expansion valve 26 is a valve which, during cooling operation, functions as a downstream side expansion valve which reduces the pressure of intermediate-pressure refrigerant in the refrigerating cycle which is accumulated in the receiver 25 to a low pressure in the refrigerating cycle, in addition, the indoor heat exchange side expansion valve 26 is a valve which, during heating operation, functions as an upstream side expansion valve which reduces the pressure of high-pressure refrigerant in the refrigerating cycle where heat is released in the indoor heat exchanger 41 to an intermediate pressure in the refrigerating cycle. The indoor heat exchange side expansion valve 26 is provided at a portion, which is closer to the liquid side shut-off valve 27, in the liquid refrigerant pipe 35. Here, an electric expansion valve is used as the indoor heat exchange side expansion valve 26.

The liquid side shut-off valve 27 and the gas side shut-off valve 28 are valves which are provided at the connection opening with external devices or piping (in detail, the liquid refrigerant linking pipe 5 and the gas refrigerant linking pipe 6). The liquid side shut-off valve 27 is provided at an end section of the liquid refrigerant pipe 35. The gas side shut-off valve 28 is provided at an end of the second gas refrigerant pipe 34.

The receiver as vent pipe 30 is a refrigerant pipe which leads intermediate-pressure gas refrigerant in the refrigerating cycle which is accumulated in the receiver 25 to the suction pipe 31 of the compressor 21. The receiver gas vent pipe 30 is provided so as to connect between an upper section of the receiver 25 and a section along the suction pipe 31. A receiver gas vent valve 30*a*, a capillary tube 30*b*, and a check valve 30*c* are provided in the receiver gas vent pipe 30. The receiver gas vent valve 30*a* is a valve which is able to be controlled to be opened and closed where the flow of refrigerating in the receiver gas vent pipe 30 is started and stopped, and an electromagnetic valve is used here. The capillary tube 30*b* is a mechanism which reduces pressure of the gas refrigerant which accumulates in the receiver 25 to a low pressure in the refrigerating cycle. A capillary tube with a diameter which is narrower than the receiver gas vent pipe is used here. The check valve 30*c* is a valve mechanism which only permits flow of refrigerant from the receiver 25 side to the suction pipe 31 side, and a check valve is used here.

The outdoor unit 2 has an outdoor fan 36 for exhausting to the outside after heat exchange with refrigerant in the outdoor heat exchanger 23 by outdoor air being suctioned into the outdoor unit 2. That is, the outdoor unit 2 has the outdoor fan 36 as a fan which supplies outdoor air to the outdoor heat exchanger 23 as a source for cooling refrigerant or a source for heating refrigerant which flows in the outdoor heat exchanger 23. Here, a propeller fan or the like which is driven using an outdoor fan motor 37 is used as the outdoor fan 36. In addition, it is possible for the number of rotations of the outdoor fan motor 37 to be changed using an inverter or the like.

Various types of sensors are provided in the outdoor unit 2. In detail, a suction temperature sensor 51, which detects a temperature Ts of low-pressure refrigerant in the refrigerating cycle which is suctioned into the compressor 21, is provided in the suction pipe 31. Here, the suction temperature sensor 51 is provided at a position on the downstream side of a portion, which mergers with the receiver gas vent pipe 30, in the suction pipe 31. A discharge temperature sensor 52, which detects a temperature Td of high-pressure refrigerant in the refrigerating cycle which is discharged from the compressor 21, is provided in the discharge pipe 32. An outdoor heat exchange intermediate temperature sensor 53, which detects a temperature Torm of refrigerant at an intermediate portion of the outdoor heat exchanger 23, and an outdoor heat exchange liquid side temperature sensor 54, which detects a temperature Torl of refrigerant at the liquid side of the outdoor heat exchanger 23, are provided in the outdoor heat exchanger 23. An outdoor temperature sensor 55 which detects a temperature Toa of outdoor air which is suctioned into the outdoor unit 2 is provided in the outdoor unit 2. A liquid pipe temperature sensor 56, which detects a liquid pipe temperature Tlp of refrigerant at a portion which is close to the indoor of the indoor heat exchange side expansion valve 26, is provided in the liquid refrigerant pipe 35.

The outdoor unit 2 has an outdoor side control section 38 which controls the actions of each section which configures the outdoor unit 2. Then, the outdoor side control section 38 has a microcomputer, memory, and the like provided to perform control of the outdoor unit 2, and is able to perform transferring of control signals and the like to and from the indoor unit 4 (that is, the indoor side control section 44) via the transfer line 8*a*.

<Refrigerant Linking Pipes>

The refrigerant linking pipes 5 and 6 are refrigerant pipes which are built on location when the air conditioning apparatus 1 is installed at an installation location such as a building and linking pipes which have various lengths and pipe diameters are used according to the instillation conditions such as the instillation location, the combination of the outdoor unit and the indoor unit, and the like.

The refrigerant circuit 10 of the air conditioning apparatus 1 is configured by connecting the outdoor unit 2, the indoor unit 4, and the refrigerant linking pipes 5 and 6 as above. The air conditioning apparatus 1 performs cooling operation by circulating refrigerant in the order of the compressor 21, the outdoor heat exchanger 23 which is the radiator, the outdoor heat exchange side expansion valve 24 which is the upstream side expansion valve, the receiver 25, the indoor heat exchange side expansion valve 26 which is the downstream side expansion valve, and the indoor heat exchanger 41 which is the evaporator. In addition, the air conditioning apparatus 1 performs heating operation by circulating refrigerant in the order of the compressor 21, the indoor heat exchanger 41 which is the evaporator, the indoor heat exchange side expansion valve 26 which is the upstream side expansion valve, the receiver 25, the outdoor heat exchange side expansion valve 24 which is the downstream side expansion valve, and the outdoor heat exchanger 23 which is the radiator by switching the four way switching valve 22 to a heating cycle state. R32 is enclosed in the refrigerant circuit 10 as refrigerant. In addition, the refrigerant circuit 10 has the receiver gas vent valve 30*a* which is able to be controlled to be opened and closed and the receiver gas vent pipe 30 is provided for leading gas refrigerant which accumulates inside the receiver 25 to the suction side of the compressor 21.

<Control Section>

It is possible for the air conditioning apparatus 1 to perform controlling of each of the devices of the outdoor unit 2 and the indoor unit 4 using the control section 8 which is configured from the indoor side control section 44 and the outdoor side control section 38. That is, the control section 8 is configured to perform operation control for the entirety of the air conditioning apparatus 1 which includes cooling operation and heating operation described above and the like using the transfer line 8*a* which is connects between the indoor side control section 44 and the outdoor side control section 38.

Figure 2:
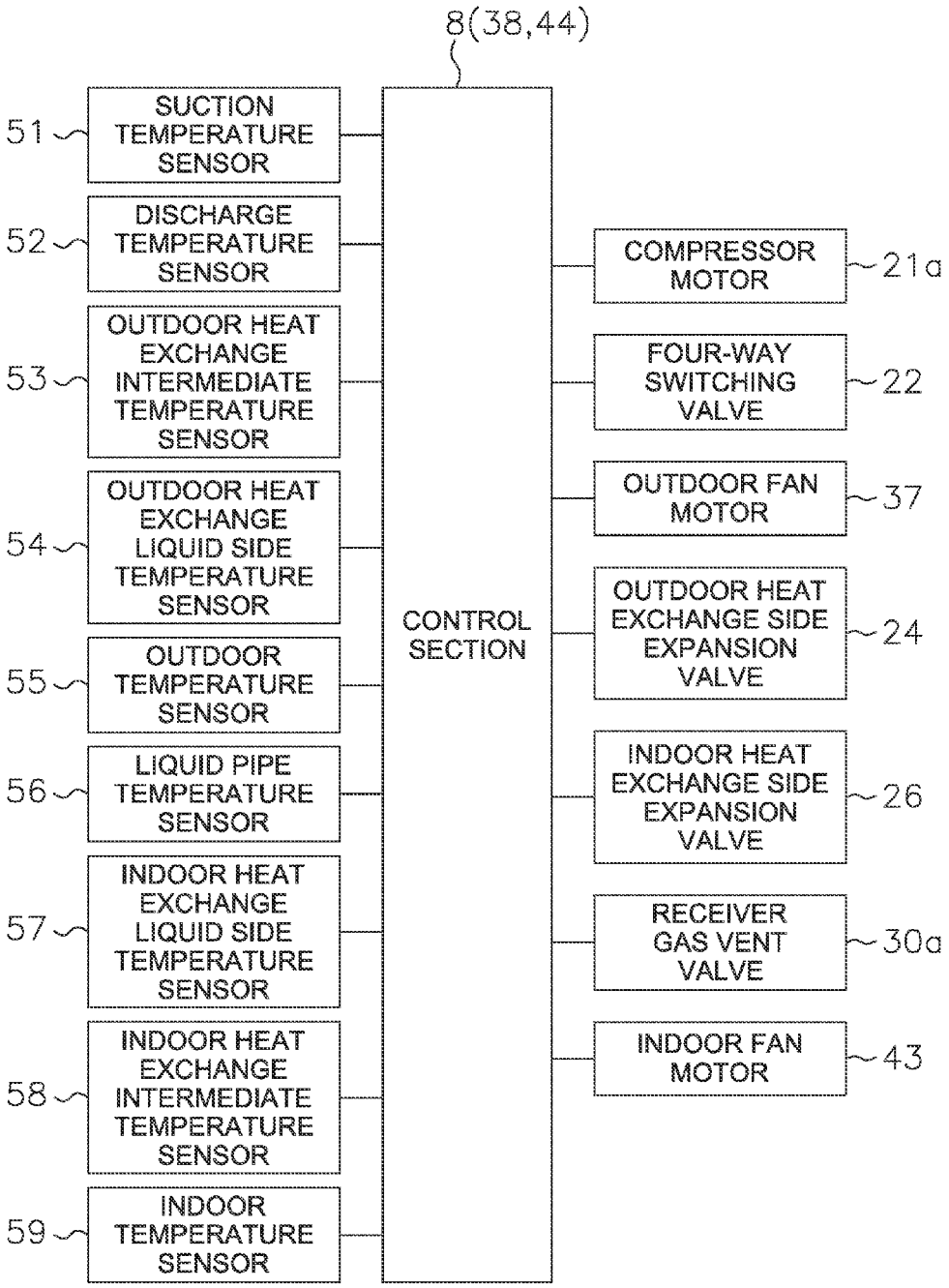
FIG. 2 is a control block diagram of an air conditioning apparatus.

The control section 8 is connected as shown in FIG. 2 so that it is possible to receive detection signals from each type of the sensors 51 to 59 and the like and is connected so that it is possible to control each type of the devices, the valves 21*a*, 22, 24, 26, 30*a*, 37, and 43, and the like based on these detection signals and the like.

(2) Basic Actions of Air Conditioning Apparatus

Basic actions of the air conditioning apparatus 1 will be described next using FIG. 1. It is possible for the air conditioning apparatus 1 to perform cooling operation and heating operation as basic actions.

<Cooling Operation>

The four way switching valve 22 is switched to the cooling cycle state (the state which is indicated by the solid line in FIG. 1) during cooling operation.

Low-pressure refrigerant in the refrigerating cycle in the refrigerant circuit 10 is suctioned into the compressor 21 and is discharged after being compressed to a high pressure in the refrigerating cycle.

The high-pressure gas refrigerant which is discharged from the compressor 21 is sent to the outdoor heat exchanger 23 via the four way switching valve 22.

The high-pressure gas refrigerant which is sent to the outdoor heat exchanger 23 becomes high-pressure liquid refrigerant in the outdoor heat exchanger 23 due to heat being released by performing heat exchange with outdoor air which is supplied as a source for cooling using the outdoor fan 36.

The high-pressure liquid refrigerant where heat is released in the outdoor heat exchanger 23 is sent to the outdoor heat exchange side expansion valve 24. The pressure of the high-pressure liquid refrigerant which is sent to the outdoor heat exchange side expansion valve 24 is reduced to an intermediate pressure in the refrigerating cycle using the outdoor heat exchange side expansion valve 24. The intermediate-pressure refrigerant where the pressure is reduced using the outdoor heat exchange side expansion valve 24 is separated into gas and liquid by being sent to the receiver 25. Then, the gas refrigerant inside the receiver 25 is sent to the suction pipe 31 via the receiver gas vent pipe 30 by opening the receiver gas vent valve 30*a*. In addition, the liquid refrigerant inside the receiver 25 is sent to the indoor heat exchange side expansion valve 26.

The pressure of the intermediate-pressure liquid refrigerant which is sent to the indoor heat exchange side expansion valve 26 is reduced to a low pressure in the refrigerating cycle using the indoor heat exchange side expansion valve 26. The refrigerant where the pressure is reduced using the indoor heat exchange side expansion valve 26 is sent to the indoor heat exchanger 41 via the liquid side shut-off valve 27 and the liquid refrigerant linking pipe 5.

The low-pressure refrigerant which is sent to the indoor heat exchanger 41 evaporates in the indoor heat exchanger 41 by performing heat exchange with indoor air which is supplied as a source for heating using the indoor fan 42. Due to this, indoor cooling is performed by the indoor air being cooled and supplied to indoors after this.

The low-pressure refrigerant which evaporates in the indoor heat exchanger 41 is merged with gas refrigerant which flows in from the receiver gas vent pipe 30 by being sent to the suction pipe 31 via the gas refrigerant linking pipe 6, the gas side shut-off valve 28, and the four way switching valve 22 and is suctioned again into the compressor 21.

<Heating Operation>

The four way switching vale 22 is switched to the heating cycle state (the state which is indicated by the dashed line in FIG. 1) during heating operation.

Low-pressure refrigerant in the refrigerating cycle in the refrigerant circuit 10 is suctioned into the compressor 21 and is discharged after being compressed to a high pressure in the refrigerating cycle.

The high-pressure gas refrigerant which is discharged from the compressor 21 is sent to the indoor heat exchanger 41 via the four way switching valve 22, the gas side shut-off valve 28, and the gas refrigerant linking pipe 6.

The high-pressure gas refrigerant which is sent to the indoor heat exchanger 41 becomes high-pressure liquid refrigerant in the indoor heat exchanger 41 due to heat being released by performing heat exchange with indoor air which is supplied as a source for cooling using the indoor fan 42. Due to this, indoor heating is performed by the indoor air being heated and supplied to indoors after this.

The high-pressure liquid refrigerant where heat is released in the indoor heat exchanger 41 is sent to the indoor heat exchange side expansion valve 26 via the liquid refrigerant linking pipe 5 and the liquid side shut-off valve 27.

The pressure of the high-pressure liquid refrigerant which is sent to the indoor heat exchange side expansion valve 26 is reduced to an intermediate pressure in the refrigerating cycle using the indoor heat exchange side expansion valve 26. The intermediate-pressure refrigerant where the pressure is reduced using the indoor heat exchange side expansion valve 26 is separated into gas and liquid by being sent to the receiver 25. Then, the gas refrigerant inside the receiver 25 is sent to the suction pipe 31 via the receiver as vent pipe 30 by opening the receiver gas vent valve 30*a*. In addition, the liquid refrigerant inside the receiver 25 is sent to the outdoor heat exchange side expansion valve 24. The pressure of the intermediate-pressure liquid refrigerant which is sent to the outdoor heat exchange side expansion valve 24 is reduced to a low pressure in the refrigerating cycle using the outdoor heat exchange side expansion valve 24. The low-pressure refrigerant where the pressure is reduced using the outdoor heat exchange side expansion valve 24 is sent to the outdoor heat exchanger 23.

The low-pressure liquid refrigerant which is sent to the outdoor heat exchanger 23 evaporates in the outdoor heat exchanger 23 by performing heat exchange with outdoor air which is supplied as a source for heating using the outdoor fan 36.

The low-pressure refrigerant which evaporates in the outdoor heat exchanger 23 is merged with gas refrigerant which flows in from the receiver gas vent pipe 30 by being sent to the suction pipe 31 via the four way switching valve 22 and is suctioned again into the compressor 21.

(3) Operation Control Including Suction Wetting Control

Here, since R32 is used as refrigerant, it is necessary to perform suction wetting control so that refrigerant at the outlet of an evaporator (the indoor heat exchanger 41 during cooling operation and the outdoor heat exchanger 23 during heating operation) is in the designated wetting state during cooling operation and during heating operation described above considering that it is easy for the temperature Td of the refrigerant which is discharged from the compressor 21 to increase. Here, there is a concern that an increase in the temperature Td of the refrigerant which is discharged from the compressor 21 will be generated when the compressor 21 suctions in refrigerant where the dryness is higher than the designated wetting state and that liquid compression will be generated when the compressor 21 suctions in refrigerant where the dryness is lower than the designated wetting state. For this reason, high controllability is demanded with regard to the suction wetting control from the point of view of securing reliability of the compressor 21. In addition, here, the concern that liquid compression will be generated is high since a configuration, where an accumulator with a large capacity which has a gas and liquid separating function is not provided, is adopted so that it is possible for refrigerant to be suctioned into the compressor 21 in a wetting state. For this reason, it is necessary for controllability of the suction wetting control to be further improved so that the compressor 21 does not suction in refrigerant where the dryness is lower than the designated wetting state.

In this manner, high controllability is demanded in suction wetting control from the point of view of securing the reliability of the compressor 21 with it being necessary to perform suction wetting control in a case where R32 is used as the refrigerant in the air conditioning apparatus 1 which has the refrigerant circuit 10 where the expansion valves 24 and 26 are provided on the upstream side and the downstream side of the receiver 25 and gas refrigerant is injected from the receiver 25 into the compressor 21.

Therefore, here, operation control which includes the suction wetting control as described below is performed during cooling operation and during heating operation.

Figure 3:
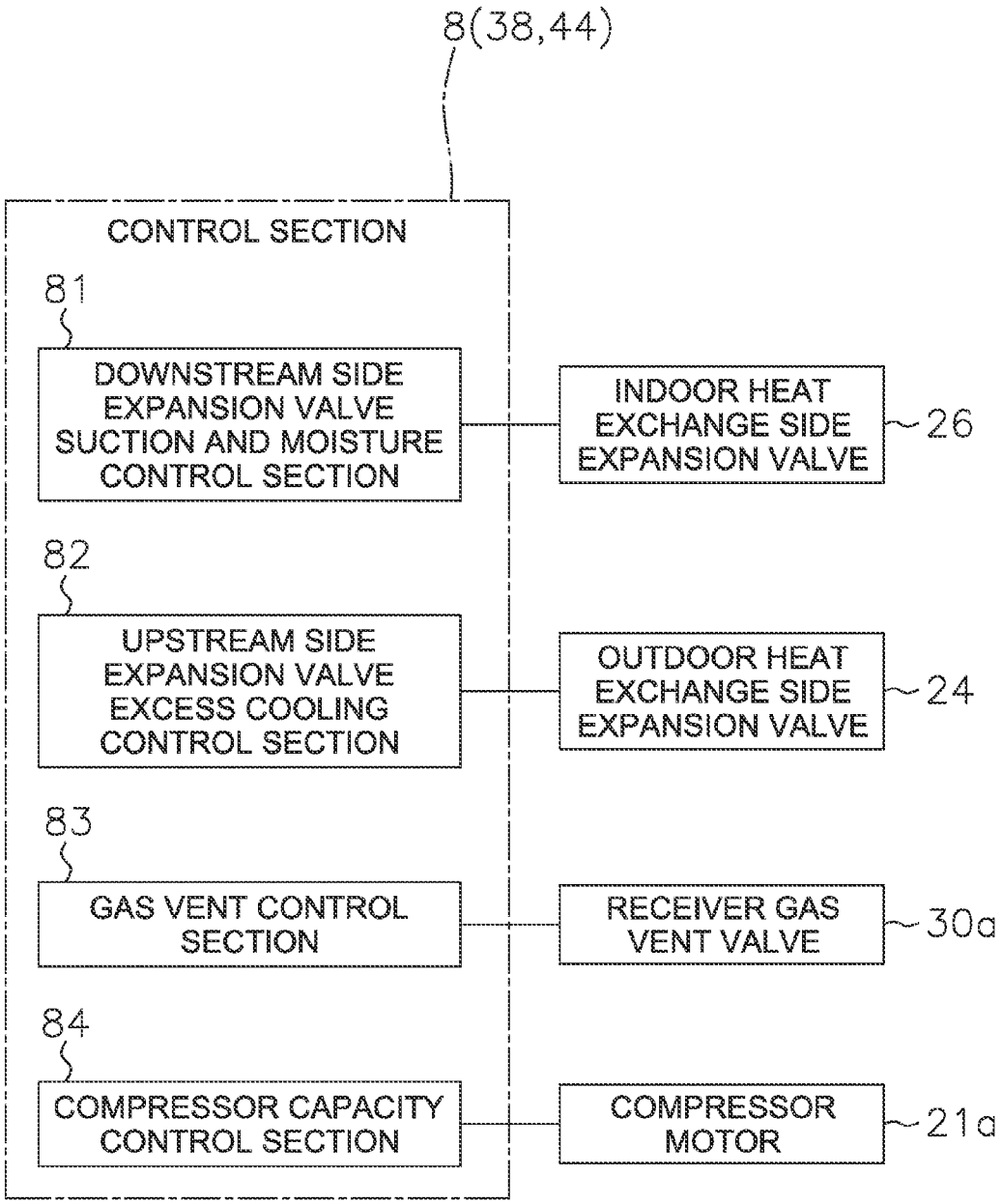
FIG. 3 is a diagram illustrating details of a control configuration which includes suction wetting control during cooling operation.
Figure 4:
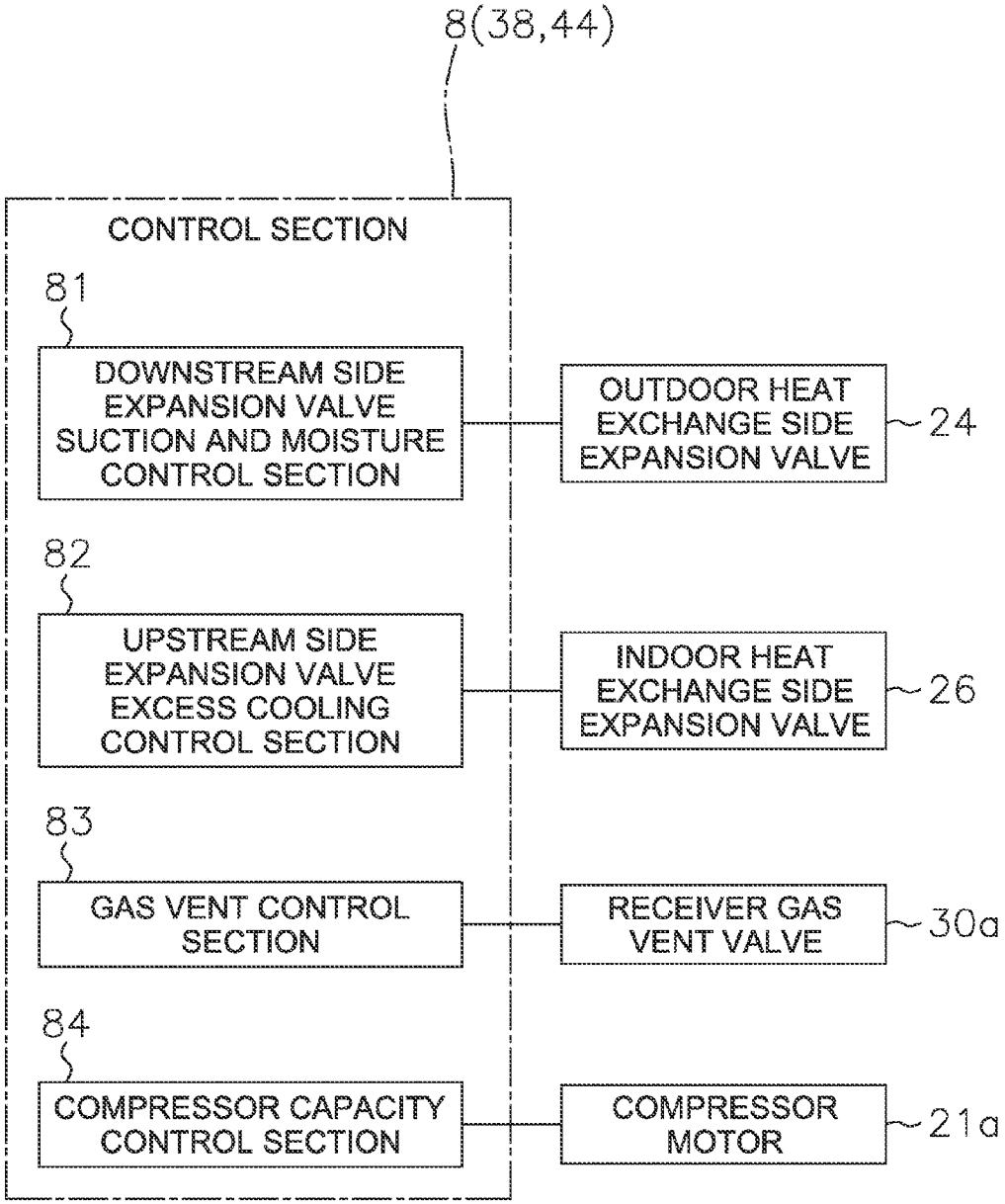
FIG. 4 is a diagram illustrating details of a control configuration which includes suction wetting control during heating operation.

Operation control which includes the suction wetting control during cooling operation and during heating operation will be described next using FIG. 1 to FIG. 4. Here, FIG. 3 is a diagram illustrating details of a control configuration which includes the suction wetting control during cooling operation. FIG. 4 is a diagram illustrating details of a control configuration which includes the suction wetting control during heating operation.

<Operation Control Including Suction Wetting Control During Cooling Operation>

Operation control which includes the suction wetting control during cooling operation will be described first.

Here, it is preferable to control a device which is able to directly control the flow rate of refrigerant which flows into the indoor heat exchanger 41 which is the evaporator in the suction wetting control since there is the refrigerant circuit 10 where the expansion valves 24 and 26 are provided on the upstream side and the downstream side of the receiver 25 and gas refrigerant is injected from the receiver 25 into the compressor 21.

Therefore, here, refrigerant is in a wetting state and a dryness Xs of the refrigerant is set to a target dryness Xst at the outlet of the indoor heat exchanger 41 by performing downstream side expansion valve suction wetting control where the opening of the indoor heat exchange side expansion valve 26, which is the downstream side expansion valve which is provided on the downstream side of the receiver 25, is changed using a downstream side expansion valve suction wetting control section 81 of the control section 8.

Here, as the downstream side expansion valve suction wetting control, control is adopted where the opening of the indoor heat exchange side expansion valve 26 is changed so that the temperature Td of the refrigerant which is discharged from the compressor 21 is set to a target discharge temperature Tdt which is equivalent to a case where the dryness Xs is set to the target dryness Xst at the outlet of the indoor heat exchanger 41. Here, it is preferable that the target dryness Xst is controlled to be in the range of 0.65 to 0.85 from the point of view of suppressing excessive increasing of the temperature Td of the refrigerant which is discharged from the compressor 21 and suppressing generating of liquid compression. However, it is not possible for the dryness Xs of refrigerant at the outlet of the indoor heat exchanger 41 to be directly detected. Therefore, here, the target discharge temperature Tdt which is equivalent to a case where the dryness Xs is the target dryness Xst (in a range of 0.65 to 085) by using the temperature Td of the refrigerant which is discharged from the compressor 21 instead of the dryness Xs, and the opening of the indoor heat exchange side expansion valve 26 is changed such that the temperature Td of the refrigerant which is discharged from the compressor 21 is the target discharge temperature Tdt. That is, it is determined that the dryness Xs is higher than the target dryness Xst in a case where the temperature Td is higher than the target discharge temperature Tdt and changing is performed so that the opening of the indoor heat exchange side expansion valve 26 is reduced. In addition, it is determined that the dryness Xs is lower than the target dryness Xst in a case where the temperature Td is lower than the target discharge temperature Tdt and changing is performed so that the opening of the indoor heat exchange side expansion valve 26 is increased.

However, at this time, it is preferable for the refrigerant which is sent from the receiver 25 to the indoor heat exchange side expansion valve 26 to be normally maintained at the state of liquid refrigerant in order for the controllability of the indoor heat exchange side expansion valve 26 to be suitable. Then, it is necessary for the flow rates of the gas refrigerant and the liquid refrigerant which flow into the receiver 25 to be stabilized, for the gas refrigerant not to flow from the receiver 25 into the indoor heat exchange side expansion valve 26, and for the liquid refrigerant to not return from the receiver gas vent pipe 30 to the suction side of the compressor 21 in order for the refrigerant which is sent from the receiver 25 to the indoor heat exchange side expansion valve 26 to be normally maintained in the state of liquid refrigerant.

Therefore, here, when performing the downstream side expansion valve suction wetting control, gas refrigerant is led from the receiver 25 to the suction side of the compressor 21 via the receiver gas vent pipe 30 which is provided in the receiver 25 by performing gas vent control where the receiver gas vent valve 30*a* is opened using a gas vent control section 83 of the control section 8, and subcooling SC of refrigerant at the outlet of the outdoor heat exchanger 23 which is a radiator is set to a target subcooling SCt by performing upstream side expansion valve subcooling control where the opening of the outdoor heat exchange side expansion valve 24, which is the upstream side expansion valve which is provided on the upstream side of the receiver 25, is changed using an upstream side expansion valve subcooling control section 82 of the control section 8.

Here, the subcooling SC of refrigerant at the outlet of the outdoor heat exchanger 23 is obtained by subtracting the temperature Torl of the refrigerant which is detected using the outdoor heat exchange liquid side temperature sensor 54 from the temperature Torm of the refrigerant which is detected using the outdoor heat exchange intermediate temperature sensor 53. The target subcooling SCt is set to a value to the extent that it is possible to secure an amount of liquid refrigerant after the pressure of refrigerant is reduced to an intermediate pressure in the refrigerating cycle using the outdoor heat exchange side expansion valve 24. Then, changing is performing so that the opening of the outdoor heat exchange side expansion valve 24 is increased in a case where the subcooling SC is larger than the target subcooling SCt. In addition, changing is performing so that the opening of the outdoor heat exchange side expansion valve 24 is reduced in a case where the subcooling SC is smaller than the target subcooling SCt.

By doing this, the flow rates of the gas refrigerant and the liquid refrigerant which pass through the outdoor heat exchange side expansion valve 24 and flow into the receiver 25 are stabilized and the gas refrigerant is stably vented out from the receiver 25 via the receiver gas vent pipe 30 due to the subcooling SC of refrigerant at the outlet of the outdoor heat exchanger 23 being set to the target subcooling SCt. For this reason, a state where there normally is liquid refrigerant in the receiver 25 is maintained and the refrigerant which is sent from the receiver 25 to the indoor heat exchange side expansion valve 26 is normally maintained in the state of liquid refrigerant.

Due to this, here, it is possible to perform the suction wetting control with high controllability when R32 is used as the refrigerant.

In addition, here, it is possible to accurately perform the suction wetting control since downstream side expansion valve suction wetting control is performed based on the temperature Td of the refrigerant which is discharged from the compressor 21.

Moreover, here, compressor capacity control is performed so that the number of rotations of the compressor 21 is changed such that a low pressure Pe in the refrigerating cycle of the refrigerant circuit 10 is set to a target low pressure Pes using a compressor capacity control section 84 of the control section 8.

Here, the low pressure Pe in the refrigerating cycle is a value where the temperature Trrm of refrigerant, which is equivalent to the evaporation temperature of refrigerant in the indoor heat exchanger 41 which is detected using the indoor heat exchange intermediate temperature sensor 58, is converted into a saturation pressure. The target low pressure Pes is set to a value to the extent that it is possible to obtain the cooling capabilities which are demanded during cooling operation. Then, changing is performed so that the number of rotations of the compressor 21 is increased in a case where the low pressure Pe is larger than the target low pressure Pos. In addition, changing is performed so that the number of rotations of the compressor 21 is reduced in a case where the low pressure Pe is smaller than the target low pressure Pes.

Due to this, it is possible to stabilize the subcooling SC and the dryness Xs and to stably perform the downstream side expansion valve suction wetting control, the gas vent control, and the upstream side expansion valve subcooling control described above since it is possible to stabilize the low pressure in the refrigerating cycle and low pressure and high pressure in the refrigerating cycle of the refrigerant circuit 10.

<Operation Control Including Suction Wetting Control During Heating Operation>

Operation control which includes the suction wetting control during heating operation will be described next.

The downstream side expansion valve suction wetting control is also performed using the downstream side expansion valve suction wetting control section 81 of the control section 8 during heating operation in the same manner as during cooling operation. In detail, refrigerant is in a wetting state and the dryness Xs of the refrigerant is set to the target dryness Xst at the outlet of the outdoor heat exchanger 23 which is the evaporator by performing the downstream side expansion valve suction wetting control where the opening of the outdoor heat exchange side expansion valve 24, which is the downstream side expansion valve which is provided on the downstream side of the receiver 25, is changed.

In addition, when performing the downstream side expansion valve suction wetting control, as refrigerant is led from the receiver 25 to the suction side of the compressor 21 via the receiver gas vent pipe 30 which is provided in the receiver 25 by performing the gas vent control where the receiver gas vent valve 30*a* is opened using the gas vent control section 83 of the control section 8, and the subcooling SC of refrigerant at the outlet of the outdoor heat exchanger 41 which is the radiator is set to the target subcooling SCt by performing the upstream side expansion valve subcooling control where the opening of the indoor heat exchange side expansion valve 26 which is the upstream side expansion valve which is provided on the upstream side of the receiver 25 is changed using the upstream side expansion valve subcooling control section 82 of the control section 8 during heating operation in the same manner as during cooling operation. Here, the subcooling SC of refrigerant at the outlet of the indoor heat exchanger 41 is obtained by subtracting the temperature Trrl of the refrigerant which is detected using the indoor heat exchange liquid side temperature sensor 57 from the temperature Trrm of the refrigerant which is detected using the indoor heat exchange intermediate temperature sensor 58.

By doing this, the flow rates of the gas refrigerant and the liquid refrigerant which pass through the indoor heat exchange side expansion valve 26 and flow into the receiver 25 are stabilized and the gas refrigerant is stably vented out from the receiver 25 via the receiver gas vent pipe 30 due to the subcooling SC of refrigerant at the outlet of the indoor heat exchanger 41 being set to the target subcooling SCt in the same manner as during cooling operation. For this reason, a state where there normally is liquid refrigerant in the receiver 25 is maintained and the refrigerant which is sent from the receiver 25 to the outdoor heat exchange side expansion valve 24 is normally maintained in the state of liquid refrigerant.

Due to this, it is also possible to perform the suction wetting control with high controllability when R32 is used as the refrigerant during heating operation.

Moreover, the compressor capacity control is also performed during heating operation so that the number of rotations of the compressor 21 is changed such that a high pressure Pc in the refrigerating cycle of the refrigerant circuit 10 is set to a target high pressure Pcs using the compressor capacity control section 84 of the control section 8.

Here, the high pressure Pc in the refrigerating cycle is a value where the temperature Trrm of refrigerant, which is equivalent to the condensation temperature of refrigerant in the indoor heat exchanger 41 which is detected using the indoor heat exchange intermediate temperature sensor 58, is converted into a saturation pressure. The target high pressure Pcs is set to a value to the extent that it is possible to obtain the heating capabilities which are demanded during heating operation. Then, changing is performing so that the number of rotations of the compressor 21 is reduced in a case where the high pressure Pc is larger than the target high pressure Pcs. In addition, changing is performing so that the number of rotations of the compressor 21 is increased in a case where the high pressure Pc is smaller than the target high pressure Pcs.

Due to this, it is possible to stabilize the subcooling SC and the dryness Xs and to stably perform the downstream side expansion valve suction wetting control, the gas vent control, and the upstream side expansion valve subcooling control described above since it is possible to stabilize the high pressure in the refrigerating cycle and low pressure and high pressure in the refrigerating cycle of the refrigerant circuit 10.

(4) Modified Example 1

Even performing operation control which includes the downstream side expansion valve suction wetting control described above, it is not possible to negate concerns that the temperature Td of the refrigerant which is discharged from the compressor 21 will excessively increase due to any unregular circumstances.

Therefore, here, the upstream side expansion valve subcooling control is performed in the same manner as described above with regard to the upstream side expansion valves 24 and 26 and the downstream side expansion valve suction wetting control is performed along with performing of discharge temperature protection control, where a designated correction opening ΔMVm is added to a lower limit opening MVm which is the control lower limit of the downstream side expansion valves 26 and 24 with regard to the downstream side expansion valves 26 and 24 in a case of satisfying a discharge temperature protection condition, which is determined when the temperature Td of the refrigerant which is discharged from the compressor 21 increases to a protection discharge temperature Tdi which is higher than the target discharge temperature Tdt or when a state amount which is correlated with the temperature Td of the refrigerant which is discharged from the compressor 21 reaches a protection state amount which corresponds to the protection discharge temperature Tdi.

Figure 5:
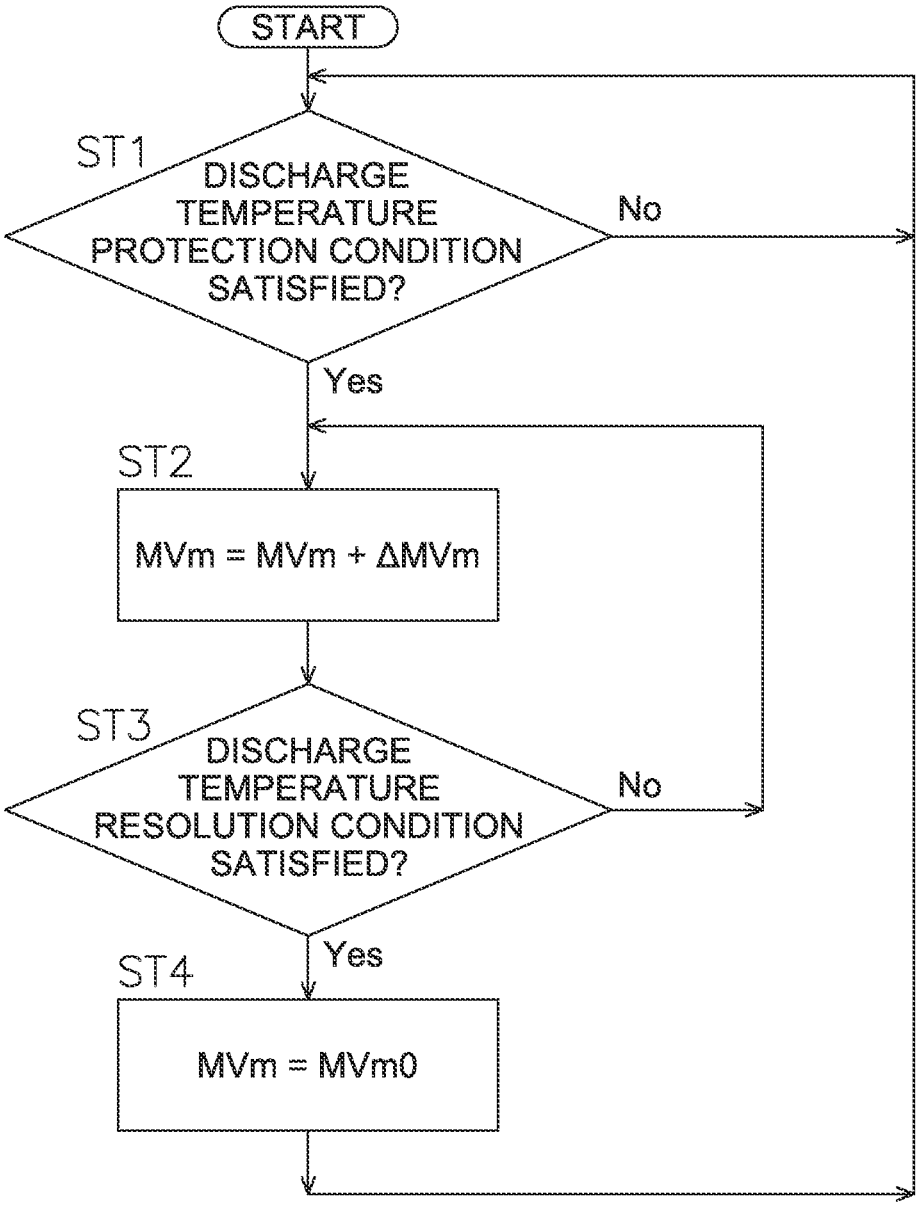
FIG. 5 is a flow chart of discharge temperature protection control.

Operation control of the discharge temperature protection control will be described next using FIG. 1 to FIG. 5. Here, FIG. 5 is a flow chart of discharge temperature protection control. The discharge temperature protection control described below is performed by the downstream side expansion valve suction wetting control section 81 of the control section 8.

During operation control which includes the upstream side expansion valve subcooling control and the downstream side expansion valve suction wetting control, the downstream side expansion valve suction wetting control section 81 firstly determines whether or not the discharge temperature protection condition is satisfied in step ST1. Here, the most direct indicator which is an indicator of whether or not the discharge temperature protection condition is satisfied is whether or not the temperature Td of the refrigerant which is discharged from the compressor 21 increases to the protection discharge temperature Tdi which is higher than the target discharge temperature Tdt. However, the indicator of whether or not the discharge temperature protection condition is satisfied is not limited to this, and whether or not the discharge temperature protection condition is satisfied may be determined depending on whether or not discharge superheating TdSH, the low pressure Pe, or suction superheating TsSH, which are state amounts which are correlated with the temperature Td of the refrigerant which is discharged from the compressor 21, reach protection discharge superheating TdSHi, protection low pressure Pei, or suction protection superheating TsSHi which are protection state amounts which correspond to the protection discharge temperature Tdi. For this reason, here, determining of whether or not the discharge temperature protection condition is satisfied is determined depending on whether or not any of the four of the state amounts Td, TdSH, Pe, and TsSH respectively reach the protection state amounts. Here, the superheating TdSH of the refrigerant which is discharged from the compressor 21 is obtained by subtracting the temperature Torm of the refrigerant which is detected using the outdoor heat exchange intermediate temperature sensor 53 from the temperature Td of the refrigerant which is discharged from the compressor 21 during cooling operation and is obtained by subtracting the temperature Trrm of the refrigerant which is detected using the indoor heat exchange side intermediate temperature sensor 58 from the temperature Td of the refrigerant which is discharged from the compressor 21 during heating operation. The superheating TsSH of the refrigerant which is suctioned into the compressor 21 is obtained by subtracting the temperature Trrm of the refrigerant which is detected using the indoor heat exchange intermediate temperature sensor 58 from the temperature Ts of the refrigerant which is suctioned into the compressor 21 during cooling operation and is obtained by subtracting the temperature Torm of the refrigerant which is detected using the outdoor heat exchange intermediate temperature sensor 53 from the temperature Ts of the refrigerant which is suctioned into the compressor 21 during heating operation.

Next, when it is determined that the discharge temperature protection condition is satisfied in step ST1, the downstream side expansion valve suction wetting control section 81 of the control section 8 performs discharge temperature protection control where the designated correction opening ΔMVm is added to the lower limit opening MVm which is the control lower limit of the downstream side expansion valves 26 and 24 in step ST2. Due to this, it is possible for the opening of the downstream side expansion valves 26 and 24 to be increased in practice while continuing with operation control which includes the upstream side expansion valve subcooling control and the downstream side expansion valve suction wetting control. The discharge temperature protection control in step ST2 is performed until a discharge temperature resolution condition is satisfied in step ST3. Here, whether or not the discharge temperature resolution condition is satisfied is determined depending on whether or not any of the four of the state amounts Td, TdSH, Pe, and TsSH respectively reach the resolution state amounts in the same manner as the discharge temperature protection condition in step ST1, in detail, whether or not the discharge temperature resolution condition is satisfied is determined depending on whether or not the temperature Td of the refrigerant which is discharged from the compressor 21 is reduced to a resolution discharge temperature Tdo which is lower than the protection discharge temperature Tdi and whether or not the discharge superheating TdSH, the low pressure Pe, or the suction superheating TsSH reach resolution discharge superheating TdSHo, resolution low pressure Peo, or resolution suction superheating TsSHo which are the resolution state amounts which correspond to the resolution discharge temperature Tdo. That is, after the discharge temperature protection condition is satisfied in step ST1, the downstream side expansion valve suction wetting control section 81 of the control section 8 repeats the discharge temperature protection control where the designated correction opening ΔMVm is added to the lower limit opening MVm which is the control lower limit of the downstream side expansion valves 26 and 24 while continuing with operation control which includes the upstream side expansion valve subcooling control and the downstream side expansion valve suction wetting control until the discharge temperature resolution condition is satisfied in step ST3. Here, the control lower limit of the downstream side expansion valves 26 and 24 has the meaning of a control lower limit in the downstream side expansion valve suction wetting control since the downstream side expansion valves 26 and 24 perform the downstream side expansion valve suction wetting control, as described above. For this reason, the designated correction opening ΔMVm is added to a lower limit opening MVm0 which is an initial value of the control lower limit in the downstream side expansion valve suction wetting control in a case where it is determined that the discharge temperature protection condition is initially satisfied in the process of step ST1, and the correction opening ΔMVm is added to the lower limit opening MVm where the correction opening ΔMVm is added.

Due to this, here, it is possible to effectively achieve discharge temperature protection by increasing the controllability in a direction where the opening is increased with regard to the downstream side expansion valves 26 and 24 while maintaining a state of control which is operation control which includes the upstream side expansion valve subcooling control and the downstream side expansion valve suction wetting control in order to accurately perform the suction wetting control.

Then, in a case where it is determined that the discharge temperature resolution condition is satisfied in step ST3, the downstream side expansion valve suction wetting control section 81 of the control section 8 returns again to the determining process of whether or not the discharge temperature protection condition of step ST1 is satisfied after the lower limit opening MVm which is the control lower limit of the downstream side expansion valves 26 and 24 is returned the lower limit opening MVm0 which is the initial value of the control lower limit in the downstream side expansion valve suction wetting control. Due to this, the downstream side expansion valve suction wetting control is resolved.

(5) Modified Example 2

The downstream side expansion valve suction wetting control section 81 of the control section 8 performs control where the correction opening ΔMVm is added to the lower limit opening MVm of the downstream side expansion valves 26 and 24 by progressing to the discharge temperature protection control in step ST2 when determining whether or not the discharge temperature protection condition is satisfied in step ST1 in modified example 1 described above. At this time, the correction opening ΔMVm may be a certain opening but may be changed according to the temperature Td of the refrigerant which is discharged from the compressor 21 or the superheating TdSH of the refrigerant which is discharged from the compressor 21.

For example, as shown in FIG. 6, the correction opening ΔMVm is set to a first correction opening ΔMVmH in order for the opening of the downstream side expansion valves 26 and 24 to be quickly increased in a case where the temperature Td of the refrigerant which is discharged from the compressor 21 or the superheating TdSH of the refrigerant which is discharged from the compressor 21 is extremely high (in a case where a first protection discharge temperature TdH or a first protection discharge superheating TdSHH are exceeded). In addition, the correction opening is set to a second correction opening ΔMVmM which is smaller than the first correction opening ΔMVmH in order for the opening of the downstream side expansion valves 26 and 24 to be gradually increased in a case where the temperature Td of the refrigerant which is discharged from the compressor 21 or the superheating TdSH of the refrigerant which is discharged from the compressor 21 is slightly high (in a case where a second protection discharge temperature TdM or a second protection discharge superheating TdSHM which are lower than the first protection discharge temperature TdH and the first protection discharge superheating TdSHH are exceeded). Furthermore, the correction opening is set to a third correction opening ΔMVmL which is smaller than the second correction opening ΔMVmM in a case where the temperature Td of the refrigerant which is discharged from the compressor 21 or the superheating TdSH of the refrigerant which is discharged from the compressor 21 is low (in a case where a third protection discharge temperature TdL or a third protection discharge superheating TdSHL which are lower than the second protection discharge temperature TdM and the second protection discharge superheating TdSHM are not exceeded). Here, the third protection discharge temperature TdL and the third protection discharge superheating TdSHL are higher than the resolution discharge temperature Tdo and the resolution discharge superheating TdSHo.

Due to this, here, it is possible to further improve controllability of discharge temperature protection by appropriately changing the extent to which the opening of the downstream side expansion valves 26 and 24 is changed according to the circumstances in discharge temperature protection control.

Here, the correction opening ΔMVm is changed according to the temperature Td of the refrigerant which is discharged from the compressor 21 or the superheating TdSH of the refrigerant which is discharged from the compressor 21 but is not limited to this and may be changed according to the low pressure Pe and the suction superheating TsSH.

INDUSTRIAL APPLICABILITY

It is possible for the present invention to be widely applied with regard to air conditioning apparatuses which have a refrigerant circuit which is configured by connecting a compressor, a radiator, an upstream side expansion valve, a receiver, a downstream side expansion valve, and an evaporator and where it is possible for refrigerant to circulate in the order of the compressor, the radiator, the upstream side expansion valve, the receiver, the downstream side expansion valve, and the evaporator.

What is claimed is:

1. An air conditioning apparatus comprising:

a refrigerant circuit including
- a compressor,
- a radiator,
- an upstream side expansion valve
- a receiver,
- a downstream side expansion valve,
- an evaporator,
- a receiver gas vent pipe, and
- an accumulator disposed between the receiver gas vent pipe and the suction side of the compressor,
- the compressor, the radiator, the upstream side expansion valve, the receiver, the downstream side expansion valve and the evaporator being connected such that refrigerant circulatable in order through the compressor, the radiator, the upstream side expansion valve, the receiver, the downstream side expansion valve, and the evaporator; and a controller, R32 being enclosed in the refrigerant circuit as the refrigerant, the receiver gas vent pipe leading gas refrigerant accumulated inside the receiver to the suction side of the compressor, the receiver gas pipe having a receiver gas vent valve controllable to be opened and closed, a gas vent control being performed so that the gas refrigerant is led from the receiver to the suction side of the compressor via the receiver gas vent pipe by opening the receiver gas vent valve, the controller being configured to execute
- an upstream side expansion valve subcooling control that changes an opening of the upstream side expansion valve such that a subcooling of the refrigerant is set to a target subcooling at an outlet of the radiator,
- a downstream side expansion valve suction wetting control that changes an opening of the downstream side expansion valve such that the refrigerant is in a wetting state with a dryness of the refrigerant set to a target dryness at an outlet of the evaporator and such that a temperature of the refrigerant discharged from the compressor is set to a target discharge temperature, the target discharge temperature being equivalent to a case in which the dryness of the refrigerant at the outlet of the evaporator is set to the target dryness, and a discharge temperature protection control in which a designated correction opening is added to a lower limit opening when a discharge temperature protection condition is satisfied, the lower limit opening being a control lower limit of the downstream side expansion valve, wherein when the discharge temperature protection condition is satisfied, the upstream side expansion valve subcooling control is performed with respect to the upstream side expansion valve and the downstream side expansion valve suction wetting control is performed with respect to the downstream side expansion valve while the discharge temperature protection control is performed with respect to the downstream side expansion valve, the discharge temperature protection condition being satisfied when the temperature of the refrigerant discharged from the compressor increases to a protection discharge temperature that is higher than the target discharge temperature, or when a state amount, which is correlated with the temperature of the refrigerant discharged from the compressor, reaches a protection state amount corresponding to the protection discharge temperature.

2. The air conditioning apparatus according to claim 1, wherein when the discharge temperature protection control is performed, the correction opening is changed according to the temperature of the refrigerant discharged from the compressor or a superheating of the refrigerant discharged from the compressor.

* * * * *